US006642843B2

(12) United States Patent
Satoh

(10) Patent No.: US 6,642,843 B2
(45) Date of Patent: Nov. 4, 2003

(54) MANAGEMENT SYSTEM

(75) Inventor: Kazuhiko Satoh, Tokyo (JP)

(73) Assignee: Allied Telesis K.K., Tokyo (JP)

( * ) Notice: Subject to any disclaimer, the term of this patent is extended or adjusted under 35 U.S.C. 154(b) by 16 days.

(21) Appl. No.: 09/998,207

(22) Filed: Dec. 3, 2001

(65) Prior Publication Data

US 2003/0058095 A1 Mar. 27, 2003

(30) Foreign Application Priority Data

Sep. 27, 2001 (JP) ..... 2001-295552

(51) Int. Cl.[7] ..... G08B 29/00

(52) U.S. Cl. ..... 340/509; 340/506; 340/526; 340/524; 340/825.36; 340/825.49; 340/3.1

(58) Field of Search ..... 340/506, 526, 340/517, 521, 524, 825.36, 825.49, 3.1

(56) References Cited

U.S. PATENT DOCUMENTS 5,682,949 A * 11/1997 Ratcliffe et al. ..... 165/209

6,437,692 B1 * 8/2002 Petite et al. ..... 340/540

FOREIGN PATENT DOCUMENTS

| | | |
|---|---|---|
| JP | 2-140319 | 11/1990 |
| JP | 5-20580 | 1/1993 |
| JP | 9-288787 | 11/1997 |

* cited by examiner

*Primary Examiner*—Daryl Pope
(74) *Attorney, Agent, or Firm*—Oblon, Spivak, McClelland, Maier & Nuestadt, P.C.

(57) ABSTRACT

A management system is provided with a sensor control means located in each region of a multiple occupancy building and a management apparatus connected to and able to communicate with the sensor control means. The sensor control means are connected with sensors for detecting the state in each area and send to the management apparatus detection information output by the sensors along with mounting location information of the sensors. Also, the management apparatus correlates and manages the detection information and mounting location information received from the sensor control means.

5 Claims, 9 Drawing Sheets

Management apparatus 10

Network device 40 having sensor control apparatus 20

Sensor controller 20 (Terminal device)

Network device 400

Transmission information from sensor control apparatus 20

(a)

| Resident | Mounting location information | Sensor type information | Detection information |
|---|---|---|---|

Management information managed by management apparatus 10

(b)

| Resident | Mounting location information | Sensor type information | Detection history information |
|---|---|---|---|

Fig.6

Transmission information from sensor control apparatus 20

(a)

| Sensor ID | Detection information |
|---|---|

Management information managed by management apparatus 10

(b)

| Sensor ID | Resident ID | Mounting location information | Sensor type information | Detection history information |
|---|---|---|---|---|

Fig.7

Management information managed by management apparatus 10

(a)

| Sensor ID | Present/not present information |
|---|---|

Fig.8

Monitoring of power consumption rate

Monitoring of water consumption rate

Monitoring of gas consumption rate

Monitoring when resident is not present

MANAGEMENT SYSTEM

BACKGROUND OF THE INVENTION

1. Field of the Invention

The present invention relates to a management system for managing various areas of a multiple occupancy building using sensors, and more particularly to a management apparatus, sensor control apparatus, and network devices for operating this management system.

2. Description of the Related Art

With the spread of LANs and WANs (Wide Area Networks) in recent years, large numbers of network devices such as personal computers (hereinafter "PCs"), hubs, switches, and routers have become connected in networks and subnets thereof, and information sharing and transmission are frequently carried out. Network devices are being established in each area of residential or office buildings, while an environment where connection to the Internet is possible is being maintained. The connection state and traffic on these network devices is generally managed by a management apparatus.

On the other hand, systems are already in operation for detecting anomalies such as gas leaks or the entry of outsiders in multiple occupancy buildings, including a plurality of residential and office spaces, and messaging a management office and security company. However, with such systems, the messaging is managed for each individual living space and individual office space. Consequently, unless the manager or security staff actually go to a location for which there was a message, they cannot specify the details of the anomaly, and particularly the location at which the anomaly is occurring. This results in an increase in the damage from the problem.

A problem of conventional management systems is that in the case where an anomaly occurs in a multiple occupancy building, the management cannot grasp in detail the specifics of the anomaly.

SUMMARY OF THE INVENTION

In view of the foregoing, it is an object of the present invention to provide a management system and the related devices thereof that can make it possible to grasp in detail the specifics of an anomaly, and quickly and correctly carry out countermeasures in the case where an anomaly occurs in a multiple occupancy building.

According to one aspect of the present invention, for achieving the above-mentioned object, there is provided a management system comprising sensor control means located in each region of a multiple occupancy building and a management apparatus connected to and able to communicate with the sensor control means, wherein the sensor control means are connected with sensors for detecting the state in each area and send to the management apparatus detection information output by the sensors along with mounting location information of the sensors and the management apparatus correlates and manages the detection information and mounting location information received from the sensor control means.

Consequently, it is possible to grasp in detail the specifics of an anomaly, and quickly and correctly carry out countermeasures in the case where an anomaly occurs in a multiple occupancy building.

According to another aspect of the present invention, there is provided a management system comprising sensor control means located in each region of a multiple occupancy building and a management apparatus connected to and able to communicate with the sensor control means, wherein the sensor control means are connected with sensors for detecting the state in each area, and send to the management apparatus detection information output by the sensors along with sensor identification information for identifying the sensors and the management apparatus is provided with storage means for correlating and storing sensor identification information and mounting location information specifying the mounting location of the sensor; and searches for the mounting location information from the storage means on the basis of the sensor identification information received from the sensor control means, and correlates and manages the detection information and the mounting location information.

Consequently, it is possible to grasp in detail the specifics of an anomaly, and quickly and correctly carry out countermeasures in the case where an anomaly occurs in a multiple occupancy building.

BRIEF DESCRIPTION OF THE DRAWINGS

FIG. 6 shows a example of transmission information of a sensor control apparatus and management information of management apparatus according to the present invention.

FIG. 7 shows a example of transmission information of a sensor control apparatus and management information of management apparatus according to the present invention.

FIG. 8 shows a example of management information of management apparatus according to the present invention.

DESCRIPTION OF THE PREFERRED EMBODIMENTS

A preferred embodiment of the invention will now be described in detail referring to the accompanying drawings.

Figure 1:
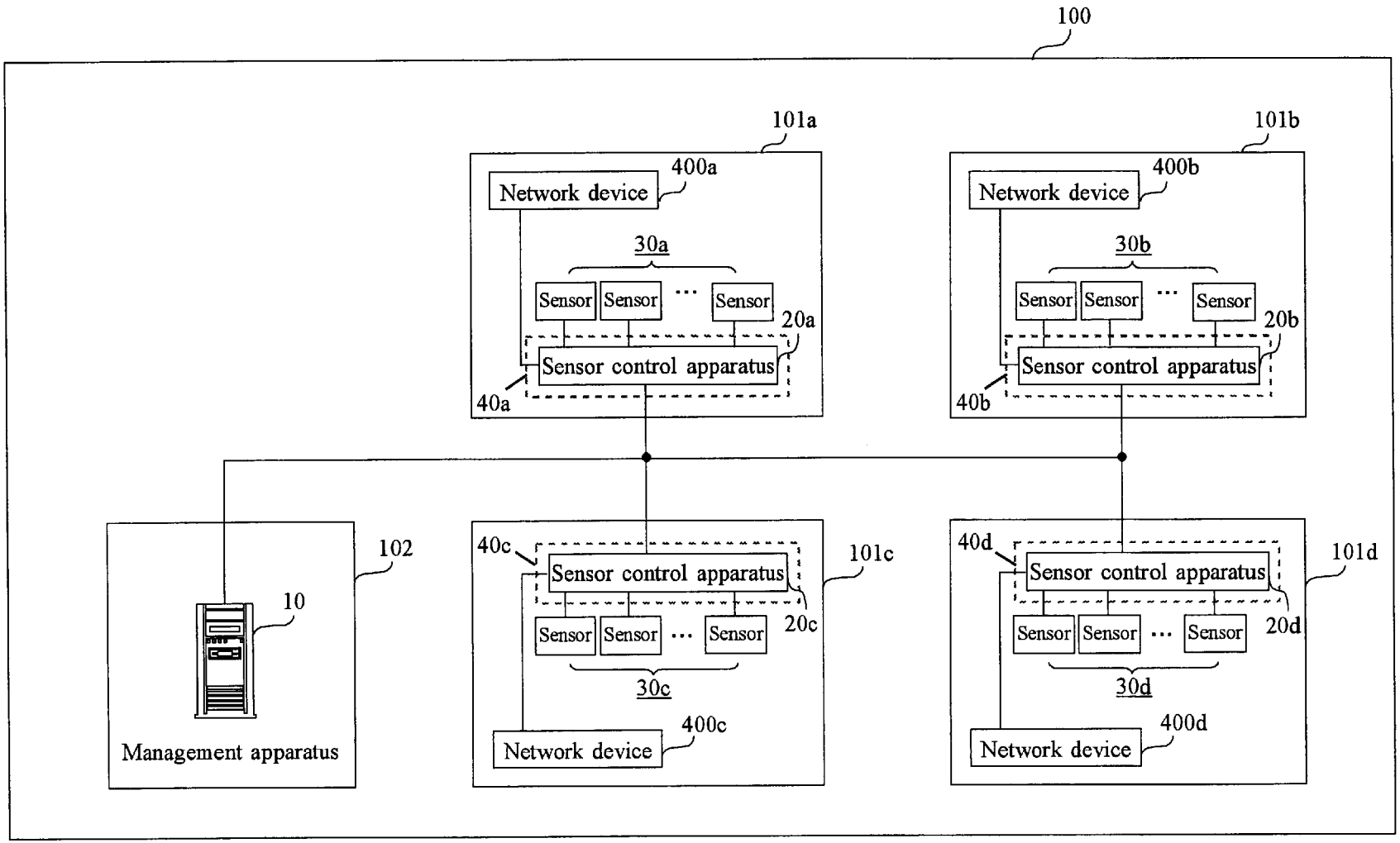
FIG. 1 shows a configuration of system according to the present invention.

FIG. 1 shows a diagram of the system configuration for the management system relating to a preferred embodiment of the present invention. This management system is applied to a multiple occupancy building 100 such as a condominium, apartment, or office building. This multiple occupancy building 100 is divided into areas 101 that are individual living spaces or office spaces. In the example explained using FIG. 1, the multiple occupancy building 100 is a condominium; the areas 101 are individual residential spaces numbered 101, 302, and so forth.

FIG. 1 shows four areas, area 101*a* through area 101*d*. Also, in the multiple occupancy building 100, a management office 102 is established in addition to the areas 101. A manager resides and a management apparatus 10 is located in this management office 102.

A plurality of sensors 30 is located in each area 101. These sensors detect the state in the area 101. For example, the sensors include gas leak sensors for directly detecting gas leaks and gas flow sensors for indirectly detecting gas leaks. These sensors also include power consumption measurement sensors used in order to detect when the switches of electrical devices are left on and leakage current sensors for detecting leakage current. Furthermore, the sensors include water leak sensors for directly detecting water leaks and water consumption measurement sensors for indirectly detecting water leaks. Other sensors can also be used. These sensors 30 output detection signals, for indicating detection by the sensors 30, as analog or digital signals.

According to a preferred embodiment, a plurality of types of sensors 30 is located in each area 101. Also, the same types of sensors 30 are preferably mounted in a plurality of locations therein. For example, sensors 30 are mounted in a plurality of locations corresponding to the type of sensor in mounting locations such as an outdoor metering room, and indoors in the kitchen, the children's room, the bathroom, the bedrooms, the hallways, and so forth.

This plurality of sensors 30 is connected to a sensor control apparatus 20 located in each area 101. A detection signal is output from each sensor 30 to the sensor control apparatus 20. The sensor control apparatus 20 executes a process of receiving such detection signals and sending the signals onward to the management apparatus 10 after adding location information for the sensors and sensor identification information to the detection signal. The handling of information between the sensors 30 and sensor control apparatus 20 may be through wired or wireless communications. In the case of wireless communications, the wiring in the multiple occupancy building can be simplified. This can prevent the development of a less attractive appearance, as well as trouble resulting from exposed wiring, such as the tripping of residents.

The output of the detection signal from a sensor 30 may be made continuously or at prescribed times. Also, a trigger signal in the case of outputting the detection signal may be generated by the sensor 30 itself, or generated by the sensor control apparatus 20 and output to the sensor 30. In this case, the sensor 30 receives the trigger signal output from the sensor control apparatus 20, initiates the detection operation, and outputs the detection signal resulting therefrom to the sensor control apparatus 20.

The sensor control apparatus 20 can recognize which sensor 30 output the detection signal. For example, the apparatus may recognize the port to which the sensor 30 is connected and recognize which sensor 30 output this signal on the basis of previously stored information. Also, in the case where the sensor 30 itself adds the sensor identification information (ID) to the detection signal, the apparatus 20 can recognize which sensor 30 output the detection signal from this identification information. When the sensor control apparatus 20 recognizes which sensor 30 output the detection signal, the apparatus acquires information relating to the sensor mounting location information and the sensor identification information, adds this information to the detection signal and sends this on to the management apparatus 10. In order to realize such processing, the sensor control apparatus 20 at least correlates and stores to storage means resident identification information and identification information for identifying the sensor, with sensor type information and sensor mounting location information.

As discussed in detail below, the sensor control apparatus 20 may be constituted by a computer such as a PC or server, or a dedicated apparatus. In the preferred embodiment of this invention, the sensor control apparatus 20 may also be installed within the network devices 40. The network devices 40 include, for example, hubs, switches, routers, other concentrators, repeaters, bridges, gateway apparatuses, PCs, servers, wireless repeaters (for example, access points that are the repeaters for wireless LANs), and game devices including communication functions. Consequently, network devices having the sensor control apparatus 20 are provided with the functions of normal network devices, in addition to the functions of the sensor control apparatus 20 for controlling the sensors 30 and sending the detection signals input from the sensors 30 to the management apparatus 10. For example, the network devices are provided with various functions according to the type of network device, such as the functions of a switching hub for reading MAC addresses of destination terminals stored in a data frame and sending packets only to the ports connected with those terminals, and router functions for connecting LANs together. For this reason, as shown in FIG. 1, other network devices 400, for example, are connected to the network devices 40 including the sensor control apparatus 20.

Also, the sensor control apparatus 20 may also be provided with determining means for comparing the detection information output from the sensors 30 with predetermined prescribed values, and on the basis of the results of that comparison, determining whether to send the information to the management apparatus 10. For example, this detection information is sent to the management apparatus 10 only in the case where the apparatus 20 judges the detection information from the sensor 30, and it is judged that an anomaly has occurred. With such a configuration, the amount of detection information received by the management apparatus 10 is reduced and only the necessary information is sent; as a result, the processing load on the management apparatus 10 can be reduced. Also, the amount of traffic on the network is reduced.

Figure 2:
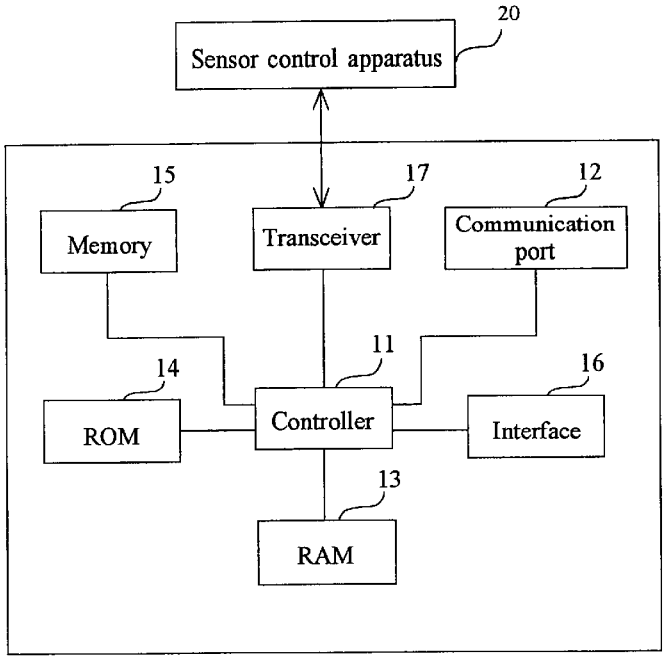
FIG. 2. is a block diagram showing a management apparatus according to the present invention.

The configuration of the management apparatus 10 used in the management system relating to the preferred embodiment is discussed in detail next using FIG. 2. The principal function of the management apparatus 10 is to manage each area 101 on the basis on the detection signals received from the sensors 30 via the sensor control apparatuses 20. In a preferred embodiment, the management apparatus 10 manages the network constituted by the network devices 400, and network devices 40, and so forth in addition to this function. The management apparatus 10 may also set the network devices 40 so that each of the areas 101 becomes a different VLAN (Virtual Local Area Network) based on the device identifiers of the network devices 400.

This management apparatus 10 may be constituted by a computer such as a personal computer (PC), dedicated computer, or server computer. As shown in FIG. 2, the management apparatus 10 is provided with a controller 11, a communications port 12, RAM 13, ROM 14, memory 15, an interface 16, and a transceiver 17. Moreover, in FIG. 2, input/output devices such as a keyboard, mouse, or other pointing device, and a display device such as a display associated with the management apparatus 10 are not shown in the drawing.

The controller 11 is a processing apparatus such as a CPU or MPU and controls the portions of the management apparatus 10. The controller 11 at least has a function for receiving signals, including detection signals sent from the sensor control apparatuses 20 and storing them in the memory 15.

The communications port 12 comprises a USB port or IEEE 1394 port capable of connecting through a LAN adapter connected to a sensor control apparatus 20, a public telephone network connected to the Internet, ISDN, or other dedicated line, through a modem or terminal adapter (TA).

The RAM 13 temporarily stores data read from the ROM 14 or memory 15, or data written to the memory 15. The ROM 14 stores various types of software necessary for operating the controller 11, firmware, and other software.

The memory 15 stores operation programs necessary for management of each area 101 and information received from the sensor control apparatuses 20. Also, the memory 15 stores operation programs necessary for management of the sensor control apparatuses 20 and network devices 40, and information and so forth received from these devices 20, 40.

The interface 16 is a USB or parallel port, for example, and connects the management apparatus 10 with external apparatuses. The interface comprises some interface, regardless of the data transfer system, parallel or serial, and of whether the connection medium is wireless or wired. The management apparatus 10 can connect with an MO drive or FD drive using the interface 16.

The transceiver 17 communicates with the sensor control apparatuses 20. The transceiver 17 at least has a number of ports corresponding to the sensor control apparatuses 20 and has the ports allocated to each sensor control apparatus 20. The connection between the transceiver 17 and sensor control apparatus 20 can use a serial cable, parallel cable, or the like; the transceiver 17 is realized as a plurality of ports connecting these to each sensor control apparatus 20. The transceiver 17 detects signals sent from the sensor control apparatuses 20 by communicating with each port and sends that information to the controller 11. The controller 11 can thereby specify the port and receive such signals. For example, a sent signal can be detected by comparing the voltage of the relay port 22 in the sensor control apparatus 20 with a prescribed slice level.

With the preferred embodiment, an entrance server and DHCP server, not shown, are installed in addition to the management apparatus 10. The entrance server stores a management table and manages the relationship of the communications parameters of the network devices 40 corresponding to the areas 101 and the device information of the network devices 40. The DHCP server allocates communications parameters among the plurality of network devices 40. The communications parameters include IP addresses, subnet masks, and default gateways.

In this management system, MAC (Media Access Control) addresses and IP (Internet protocol) addresses may be used as information for identifying each network device 40, sensor control apparatus 20, and other devices. A MAC address is an address for identifying an information device connected to a LAN and is called the hardware address of a repeater located on a communications line for reaching an IP address. An IP address is an address allocated to a computer connected to a TCP/IP networking environment and is expressed with a decimal number from 0 to 255 divided into four sections with periods. An IP address includes an IP header provided by the IP protocol located at the TCP/IP protocol network layer. The user ID and password are identifiers for identifying a user when the user of a network device 40 logs into the network.

The configuration of a network device 40 provided with a sensor control apparatus 20 is discussed in detail below using FIG. 3. The network device 40 in this case is a switching hub, for example, but may also be a switch, a router, other concentrator, PC, or wireless repeater.

Figure 3:
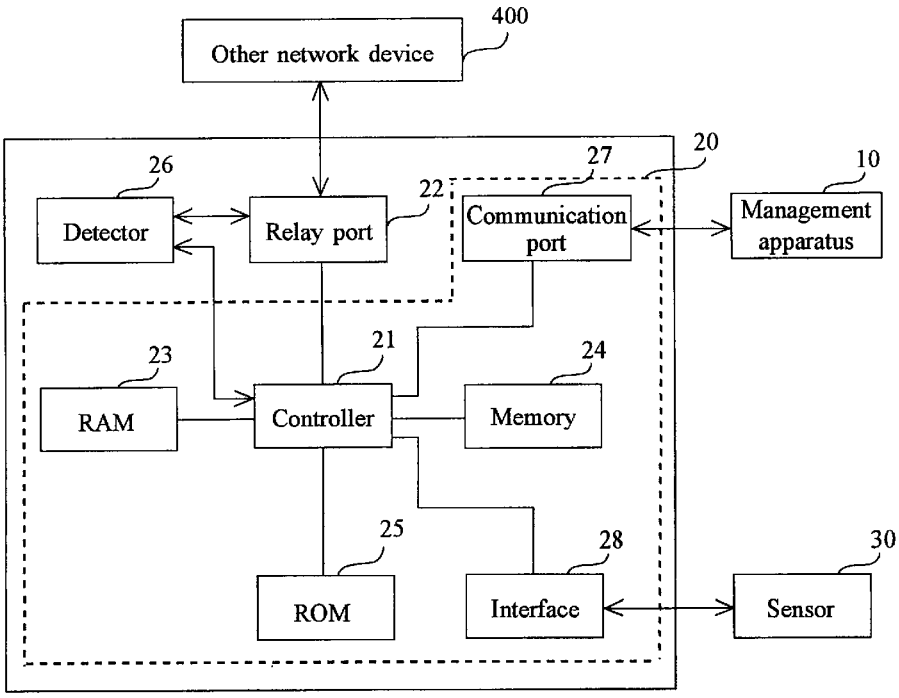
FIG. 3 is a block diagram showing a network device having a sensor control apparatus according to the present invention.

The sensor control apparatus 20 shown in FIG. 3 is realized by installing a dedicated board for a sensor control apparatus, for example, in a network device 40. For example, the sensor control apparatus 20 shown in FIG. 3 is the portion outlined with the dotted line, and is provided with a controller 21, RAM 23, memory 24, ROM 25, communications port 27, and interface 28. In these elements, the controller 21, RAM 23, memory 24, ROM 25, and communications port 27 are also used in the elements of the network device 40. The network device 40 is further provided with a relay port 22 and detector 26 as part of its own configuration. For convenience, the input/output devices and display devices associated with the sensor control apparatus 20 and network device 40 are omitted from FIG. 3 as well.

The controller 21 is a processing device such as a CPU or MPU and controls each portion of the sensor control apparatus 20. Particularly in this embodiment, the controller 21 executes processing relating to the detection signals output by the sensors 30. Also, the controller 21 communicates with the detector 26 and provides the information for identifying other network devices 400 to the entrance server, and according to instructions from the management apparatus 10, manages the relay port 22 that should logically devide the network on the basis of the MAC addresses of other network devices 400 connected with the network device 40.

The relay port 22 is a communications port connecting to other network devices 400 with a cable or the like.

The RAM 23 temporarily stores data read from the memory 24, ROM 25, and so forth, or data written to the memory 24. The memory 24 stores programs for managing the relay port 22. The ROM 25 stores various types of software necessary for operating the controller 21, firmware, and other software.

The detector 26 detects whether power is applied to other network devices 400 by communicating with the relay port 22 and sends that information to the controller 21.

The communications port 27 comprises a USB port or IEEE 1394 port capable of connecting with a LAN adapter, a public telephone network, ISDN, or other dedicated line connected to the Internet, through a modem or terminal adapter (TA). A sensor control apparatus 20 can communicate with the management apparatus 10 and entrance server through the communications port 27.

The interface 28 is a USB or parallel port, for example, and connects the sensor control apparatus 20 with external apparatuses. The interface comprises some interface, regardless of the data transfer system, parallel or serial, and of whether the connection medium is wireless or wired. Here, the interface 28 connects with the sensors 30.

Figure 4:
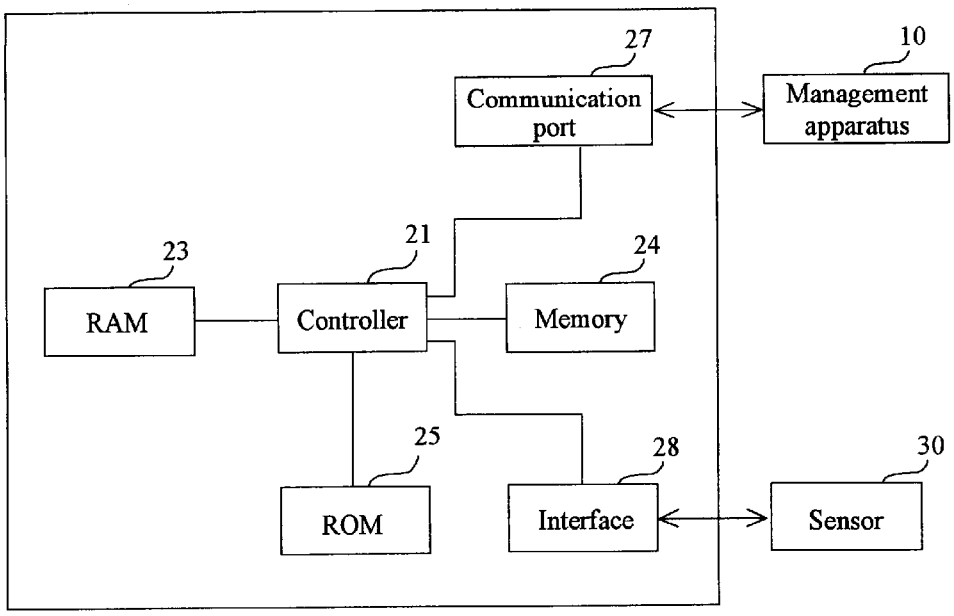
FIG. 4 is a block diagram showing a sensor control apparatus according to the present invention.

The configuration becomes as shown in FIG. 4 in the case where the sensor controller 20 is constituted by a terminal device such as a computer. As shown in this drawing, this sensor controller 20 is not provided with a relay port 22 or detector 26, unlike the case where the sensor controller is constituted by a network device. For other configurations, an explanation is omitted because these are basically the same as the configuration explained using FIG. 3.

The configuration of the network device 400 is explained next using FIG. 5. The network device 400 is an apparatus subject to management by the management apparatus 10 and is a network device such as a hub, switch, router, other concentrator, repeater, bridge, gateway apparatus, PC, server, wireless repeater, or game device having a communications function.

Figure 5:
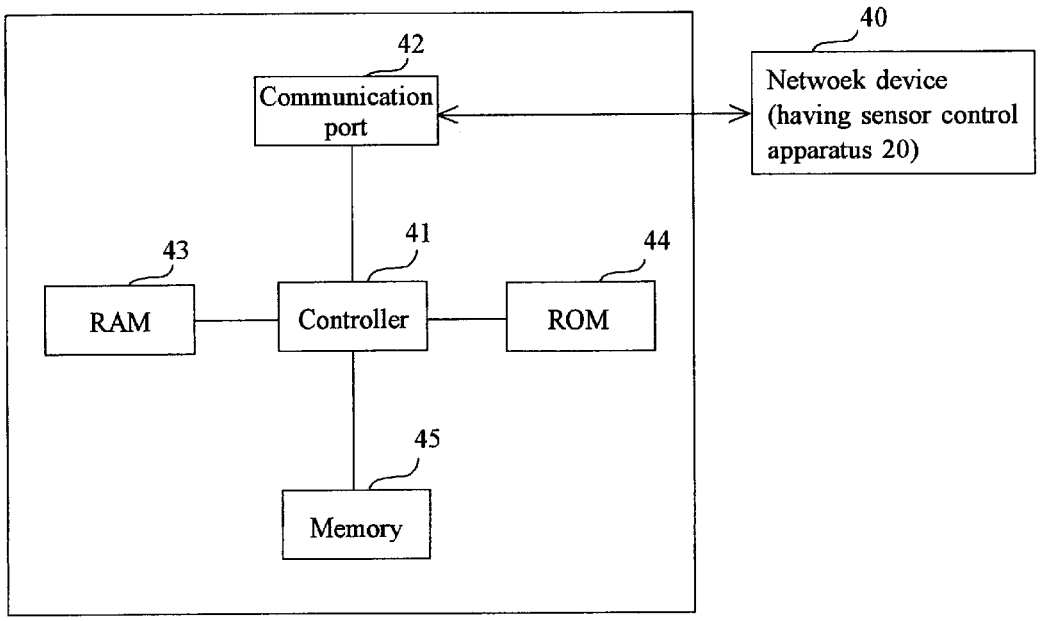
FIG. 5 is a block diagram showing a network device according to the present invention.

As shown in FIG. 5, the network device 400 comprises a controller 41, communications port 42, RAM 43, ROM 44, and memory 45. For convenience, the input/output apparatus and display apparatuses associated with the network device 400 are omitted from FIG. 5 as well. The operator of the network device 400 uses an input device, and can input various types of data to memory 45, and download necessary software to the RAM 43, ROM 44, and memory 45.

The controller 41 is a processing apparatus such as a CPU or MPU and controls various parts of the network devices 400.

The communications port 42 comprises a USB port or IEEE 1394 port capable of connecting with a LAN adapter connected to a network, a public telephone network connected to the Internet, ISDN, or other dedicated line, through a modem or terminal adapter (TA). In this embodiment, the communications port 42 is an interface connected to the relay port 22 of the network device 40.

The RAM 43 temporarily stores data read from the ROM 54 or memory 55, or data written to the memory 45. The ROM 44 stores various types of software necessary for operating the controller 41, firmware, and other software. The memory 45 stores communications parameters and the program for setting those parameters. The setting program is a program for receiving and setting communications parameters from the DHCP server.

The information sent from the sensor control apparatus 20 to the management apparatus 10 and the information managed in the management apparatus 10 are explained next using FIGS. 6 and 7. The present embodiment includes two processing methods, in the case of handling information shown in FIG. 6 (hereinafter "first example"), and a case of handling information shown in FIG. 7 (hereinafter "second example").

In the first example, as shown in FIG. 6(*a*), the resident ID, mounting location information, sensor type information, and detection information are sent from the sensor control apparatus 20 to the management apparatus 10. The "resident ID" is resident identification information. The "mounting location information" is information showing the mounting location of the sensor 30. The "sensor type information" is information indicating the type of sensor 30, such as a gas leak detecting sensor, or power consumption detecting sensor. The "detection information" is the information relating to the detection signal output by the sensor 30.

In the first example, as shown in FIG. 6(*b*), the management apparatus 10 manages by correlating the resident ID, mounting location information, sensor type information, and detection history information, and storing this in the memory 15. The "detection history information" is detection information received from the sensor control apparatus 20 and is all the information received in the past. This detection history information also includes the time received information.

In the second example, as shown in FIG. 7(*a*), the sensor ID and detection information are sent from the sensor control apparatus 20 to the management apparatus 10. The "sensor ID" is identification information for identifying each sensor. According to the preferred embodiment, such sensor IDs are different identification information allocated among all the many sensors processed by the management apparatus 10.

In the second example, as shown in FIG. 7(*b*), the management apparatus 10 manages by storing the sensor ID, resident ID, mounting location information, sensor type information, and detection history information in the memory 15. In this example, this sensor ID is correlated in advance with the resident ID, mounting location information, sensor type information, and detection history information and stored in the memory 15 of the management apparatus 10. Then, this sensor ID and detection information are received, this information is extracted with the sensor ID as the key, and the detection information is added to the detection history information.

As shown in FIG. 8, the management apparatus 10 may also correlate the resident ID and present/not present information, store this in the memory 15, and carry out management. This "present/not present information" is information showing whether the resident is in or out. This information may be input when the resident goes out and returns, or maybe acquired through detection by a body detection sensor.

The process flow of management carried out by the management apparatus 10 is explained next using the flow charts in FIGS. 9 through 14.

Figure 9:
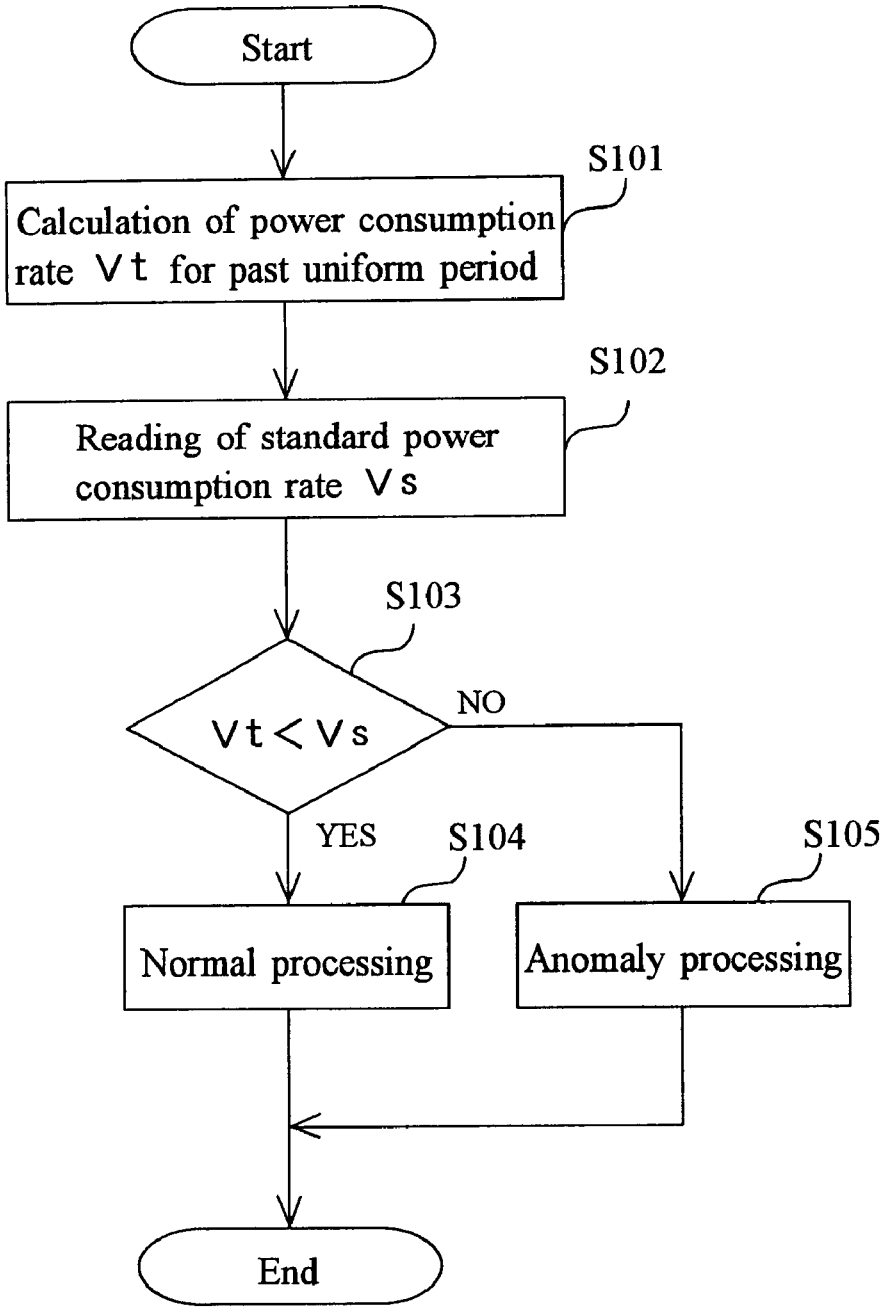
FIG. 9 is a flowchart showing a process of management apparatus.

FIG. 9 is a flowchart showing the process for monitoring the power consumption rate. The management apparatus 10 calculates the power consumption rate Vt for a prior uniform period according to the detection history information stored in the memory 15 (S101). For example, the power consumption rate for one day or the power consumption rate for one week is calculated. Next, the apparatus reads a standard power consumption rate Vs stored in advance from the memory 15 (S102). This standard power consumption rate Vs is determined on the basis of a normal power consumption rate Vn. This normal power consumption rate Vn is determined with the standard being the power consumption rate for the same period one year before, for example. This may also be determined with the standard being the power consumption rate for the same period for several years. By having the standard being the power consumption rate for an identical period in this way, the seasonal nature of power consumption can be accurately reflected. In the case where the power consumption rate Vt is the power consumption rate for a short period such as one day, the standard may also be an average power consumption rate for several days prior. This standard power consumption rate Vs includes the past normal power consumption rate Vn multiplied by a standard coefficient. For example, the coefficient is 1.2 in the case of determining an anomalous state, such as a power leak or a switch being left on, when power consumption is 20% or more higher than normal.

Next, the power consumption rate Vt is compared with the standard power consumption rate Vs (S103). When the power consumption rate Vt is less than the standard power consumption rate Vs, the judgment is that an anomaly is not occurring, meaning normal, and the normal processing is executed (S104).

On the other hand, in the case where the power consumption rate Vt is the same as or greater than the standard power consumption rate Vs, it is possible that an anomaly is occurring and the anomaly processing is executed (S105). The anomaly processing includes, for example, indicating an anomaly on the display of the management apparatus 10 and emitting a voice alarm. In other words, in the anomaly processing, processing is carried out so as to appeal to the visual and aural senses of the manager so that the manager recognizes that there is an anomaly. The results of the normality judgment are stored in the memory 15 of the management apparatus 10 as appropriate.

Figure 10:
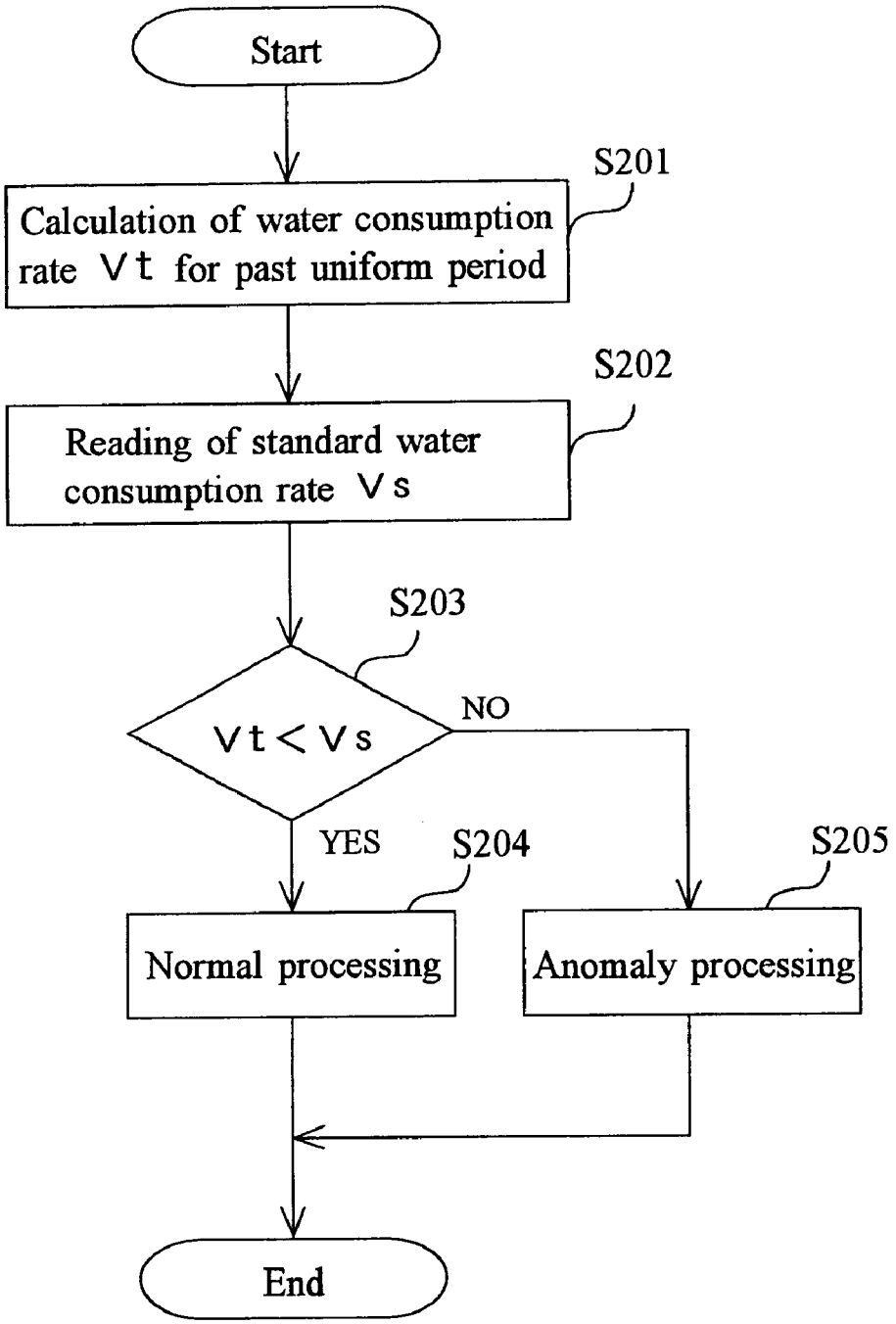
FIG. 10 is a flowchart showing a process of management apparatus.

FIG. 10 is a flowchart showing the process for monitoring water consumption rates. The management apparatus 10 calculates the water consumption rate Vt for a prior uniform period according to the detection history information stored in the memory 15 (S201) For example, the consumption rate for one day or the water consumption rate for one week is calculated. Next, the apparatus reads a standard water consumption rate Vs stored in advance from the memory 15 (S202). This standard water consumption rate Vs is determined on the basis of a normal water consumption rate Vn. This normal water consumption rate Vn is determined with the standard being the water consumption rate for the same period one year before, for example. This may also be determined with the standard being the water consumption rate for the same period for several years. By having the standard being the water consumption rate for an identical period in this way, the seasonal nature of water consumption can be accurately reflected. In the case where the water consumption rate Vt is the water consumption rate for a short period such as one day, the standard may also be an average water consumption rate for several days prior. This standard water consumption rate Vs includes the past normal water consumption rate Vn multiplied by a standard coefficient. For example, the coefficient is 1.2 in the case of determining an anomalous state, such as water leak or a switch being left on, when water consumption is 20% or more higher than normal.

Next, the water consumption rate Vt is compared with the standard water consumption rate Vs (S203). When the water consumption rate Vt is less than the standard water consumption rate Vs, the judgment is that an anomaly is not occurring, meaning normal, and the normal processing is executed (S204).

On the other hand, in the case where the water consumption rate Vt is the same as or greater than the standard water consumption rate Vs, it is possible that an anomaly is occurring and the anomaly processing is executed (S205). The anomaly processing includes, for example, indicating an anomaly on the display of the management apparatus 10 and emitting a voice alarm. In other words, in the anomaly processing, processing is carried out so as to appeal to the visual and aural senses of the manager so that the manager recognizes that there is an anomaly. The results of the normality judgment are stored in the memory 15 of the management apparatus 10 as appropriate.

Figure 11:
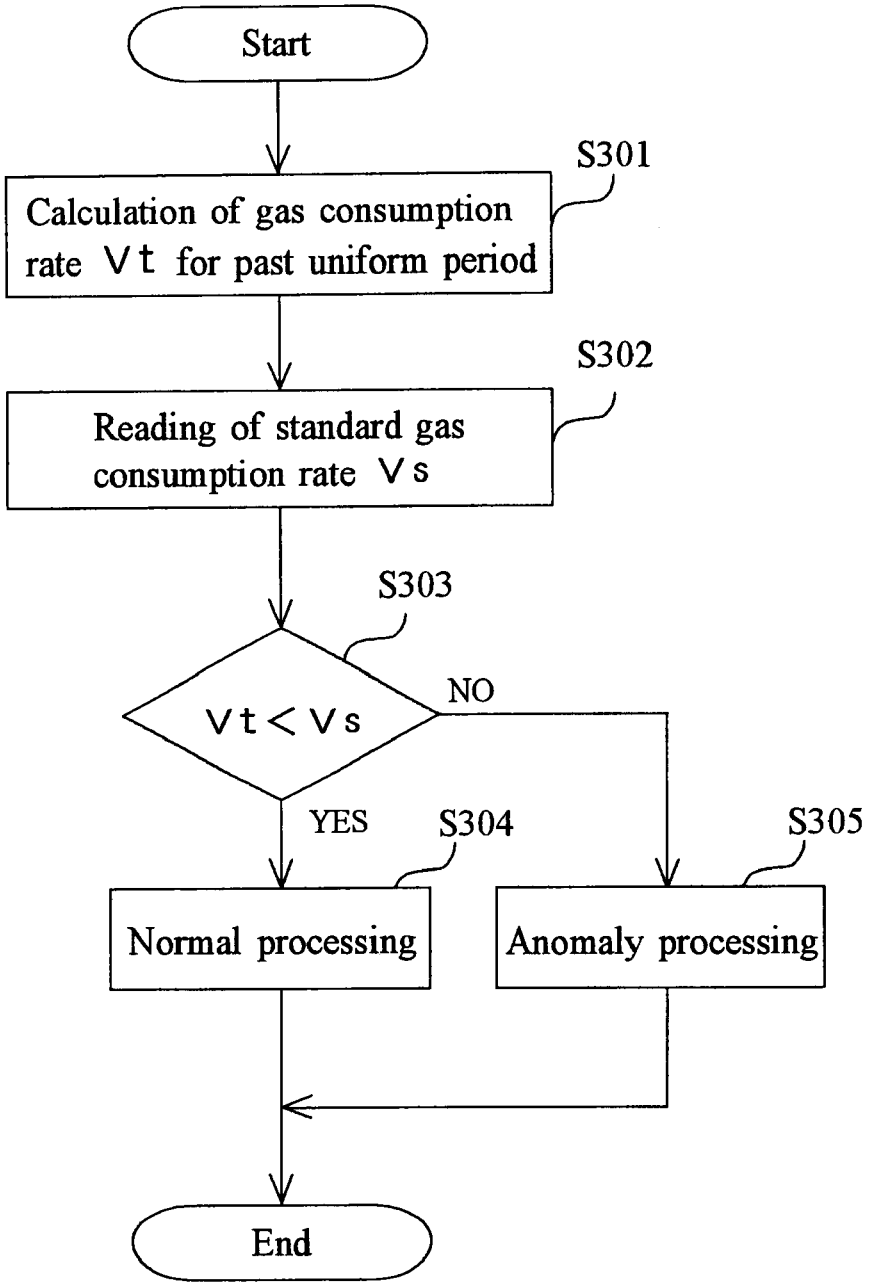
FIG. 11 is a flowchart showing a process of management apparatus.

FIG. 11 is a flowchart showing the process for monitoring gas consumption rates. The management apparatus 10 calculates the gas consumption rate Vt for a prior uniform period according to the detection history information stored in the memory 15 (S301) For example, the consumption rate for one day or the gas consumption rate for one week is calculated. Next, the apparatus reads a standard gas consumption rate Vs stored in advance from the memory 15 (S302). This standard gas consumption rate Vs is determined on the basis of a normal gas consumption rate Vn. This normal gas consumption rate Vn is determined with the standard being the gas consumption rate for the same period one year before, for example. This may also be determined with the standard being the gas consumption rate for the same period for several years. By having the standard being the gas consumption rate for an identical period in this way, the seasonal nature of gas consumption can be accurately reflected. In the case where the gas consumption rate Vt is the gas consumption rate for a short period such as one day, the standard may also be an average gas consumption rate for several days prior. This standard gas consumption rate Vs includes the past normal gas consumption rate Vn multiplied by a standard coefficient. For example, the coefficient is 1.2 in the case of determining an anomalous state, such as a gas leak or a switch being left on, when gas consumption is 20% or more higher than normal.

Next, the gas consumption rate Vt is compared with the standard gas consumption rate Vn (S303). When the gas consumption rate Vt is less than the standard gas consumption rate Vs, the judgment is that an anomaly is not occurring, meaning normal, and the normal processing is executed (S304).

On the other hand, in the case where the gas consumption rate Vt is the same as or greater than the standard gas consumption rate Vs, it is possible that an anomaly is occurring and the anomaly processing is executed (S305). The anomaly processing includes, for example, indicating an anomaly on the display of the management apparatus 10 and emitting a voice alarm. In other words, in the anomaly processing, processing is carried out so as to appeal to the visual and aural senses of the manager so that the manager recognizes that there is an anomaly. The results of the normality judgment are stored in the memory 15 of the management apparatus 10 as appropriate.

Figure 12:
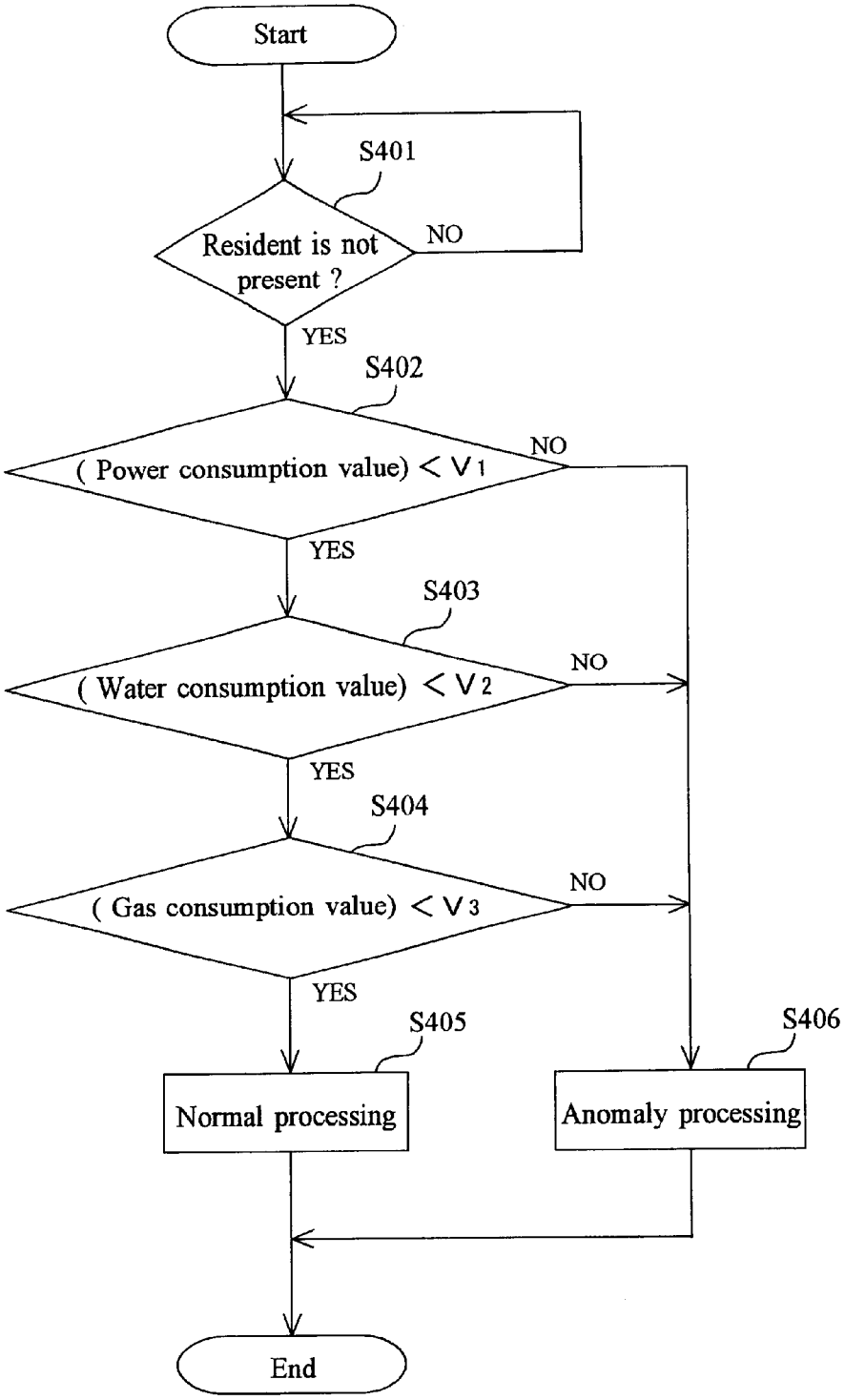
FIG. 12 is a flowchart showing a process of management apparatus.

FIG. 12 shows the process flow in the case where the monitoring process is carried out on the basis of the resident present/not present information. First it is determined whether the resident is present (S401). In the case where it is judged that the resident is not present, it is determined whether the power consumption rate detected by the sensor 30 is less than a predetermined standard value V1 (S402). In the case where the result of the determination is that the power consumption rate is greater than or equal to the standard value V1, anomaly processing is carried out (S406). On the other hand, when it is determined that the power consumption rate is less than the standard value V1, it is determined whether the water consumption rate is less than the predetermined standard value V2 (S403). In the case where the result of the determination is that the water consumption rate is greater than or equal to the standard value V2, anomaly processing is carried out (S406). On the other hand, when it is determined that the water consumption rate is less than the standard value V2, it is determined whether the gas consumption rate is less than the predetermined standard value V3 (S404). In the case where the result of the determination is that the gas consumption rate is greater than or equal to the standard value V3, anomaly processing is carried out (S406). On the other hand, when it is determined that the gas consumption rate is less than the standard value V3, normal processing is carried out (S405).

Figure 13:
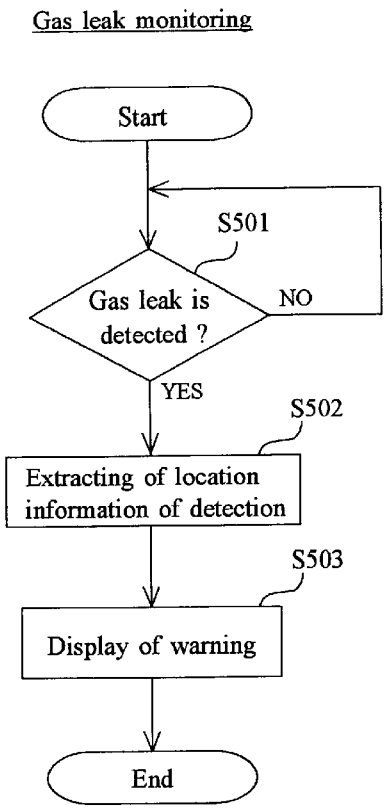
FIG. 13 is a flowchart showing a process of management apparatus.

FIG. 13 is a flowchart showing the gas leak monitoring flow. First the management apparatus 10 determines whether a gas leak is detected according to the detection signal from the sensor 30 (S501). In the case where a gas leak is detected as result of this determination, the mounting location information of the sensor sent along with that detection information, or the mounting location information extracted on the basis of the sensor ID sent along with the detection information, is acquired. The management apparatus 10 extracts this mounting location information as the information for the location at which the gas leak was detected (S502).

The management apparatus 10 displays a warning on the display (S503). This warning includes the information showing that a gas leak is occurring and the information for the location at which the gas leak was detected.

Figure 14:
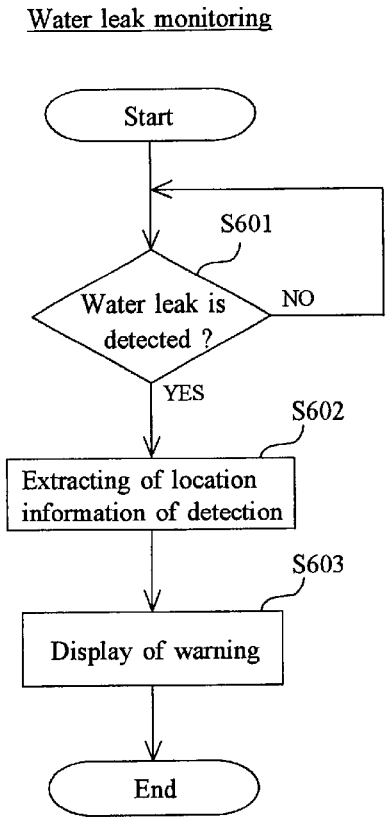
FIG. 14 is a flowchart showing a process of management apparatus.

FIG. 14 is a flowchart showing the water leak monitoring flow. First the management apparatus 10 determines whether a water leak is detected according to the detection signal from the sensor 30 (S601). In the case where a water leak is detected as result of this determination, the mounting location information of the sensor sent along with that detection information, or the mounting location information extracted on the basis of the sensor ID sent along with the detection information, is acquired. The management apparatus 10 extracts this mounting location information as the information for the location at which the water leak was detected (S602).

The management apparatus 10 displays a warning on the display (S603). This warning includes the information showing that a water leak is occurring and the information for the location at which the water leak was detected.

The present invention was explained in detail using the drawings, but the scope of the present invention is not limited by these.

The present invention can provide a management system and related devices whereby, when an anomaly occurs in a multiple occupancy building, the details of that anomaly can be determined and countermeasures taken quickly and properly; the asset value of the building can be raised with the full development of the management system.

While preferred embodiments of the invention have been described using specific terms, such description is for illustrative purposes only, and it is to be understood that changes and variations may be made without departing from the spirit or scope of the following claims.

What is claimed is:

1. A management apparatus comprising storage means for correlating and storing sensor identification information for identifying sensors for detecting the state in each area of a multiple occupancy building, and the mounting location information of the sensors;

said management apparatus receiving the sensor detection information and sensor identification information sent from the sensor control means connected with said sensor, searching for said mounting location information from said storage means on the basis of the sensor identification information, and correlating and managing the detection information and mounting location information;

said management apparatus further comprising, determining means for analyzing said detection information and determining the occurrence of an anomaly; and alarm outputting means for outputting alarms in the case where an anomaly is determined to have occurred by said determining means;

wherein said determining means analyze the detection information and determine the occurrence of an anomaly on the basis of prior detection history information.

2. A management apparatus for receiving sensor detection information and mounting location information sent from sensor control means connected with sensors for detecting the state in each area of a multiple occupancy building, and correlating and managing the detection information and mounting location information;

said management apparatus further comprising, determining means for analyzing the detection information and determining the occurrence of an anomaly; and alarm outputting means for outputting alarms in the case where an anomaly is determined to have occurred by said determining means;

wherein said determining means determine the occurrence of an anomaly on the basis of information that the resident is not present in each area of said multiple occupancy building.

3. A management apparatus comprising storage means for correlating and storing sensor identification information for identifying sensors for detecting the state in each area of a multiple occupancy building, and the mounting location information of the sensors;

said management apparatus receiving the sensor detection information and sensor identification information sent from the sensor control means connected with said sensor, searching for said mounting location information from said storage means on the basis of the sensor identification information, and correlating and managing the detection information and mounting location information;

said management apparatus further comprising, determining means for analyzing said detection information and determining the occurrence of an anomaly; and alarm outputting means for outputting alarms in the case where an anomaly is determined to have occurred by said determining means;

wherein said determining means determine the occurrence of an anomaly on the basis of information that the resident is not present in each area of said multiple occupancy building.

4. A management apparatus for receiving sensor detection information and mounting location information sent from sensor control means connected with sensors for detecting the state in each area of a multiple occupancy building, and correlating and managing the detection information and mounting location information;

said management apparatus further comprising, determining means for analyzing the detection information and determining the occurrence of an anomaly; and alarm outputting means for outputting alarms in the case where an anomaly is determined to have occurred by said determining means;

wherein said determining means analyze the detection information and determine the occurrence of an anomaly on the basis of prior detection history information.

5. The management apparatus, according to any one of claims 2, 3, 4 and 1 wherein said sensors detect one or more states relating to gas, power, and water.

* * * * *